US005179989A

United States Patent [19]

Schön

[11] Patent Number: 5,179,989

[45] Date of Patent: Jan. 19, 1993

[54] DEVICE FOR TRANSMITTING A DRIVE FORCE BETWEEN A FLEXIBLE ELEMENT AND A ROTATABLE BODY

[75] Inventor: Siegfried J. Schön, Etten-Leur, Netherlands

[73] Assignee: Schon B.V., Breda, Netherlands

[21] Appl. No.: 521,725

[22] Filed: May 10, 1990

[30] Foreign Application Priority Data

May 10, 1989 [NL] Netherlands ..... 8901176

[51] Int. Cl.[5] ..... E06B 9/06

[52] U.S. Cl. ..... 160/84.1; 160/279; 160/321

[58] Field of Search ..... 160/84.1, 279, 321, 160/188, 193; 474/87

[56] References Cited

U.S. PATENT DOCUMENTS 146,685 1/1874 Jones et al. ..... 474/87 X
3,618,418 11/1971 Chittenden ..... 474/87 X
4,852,627 8/1989 Peterson .

FOREIGN PATENT DOCUMENTS 0127107 12/1984 European Pat. Off. .
1683457 10/1969 Fed. Rep. of Germany .
413872 7/1933 United Kingdom .
496243 11/1938 United Kingdom ..... 160/84.1
2179387 3/1987 United Kingdom .
2179907 3/1987 United Kingdom .

*Primary Examiner*—Blair M. Johnson
*Attorney, Agent, or Firm*—Jacobson, Price, Holman & Stern

[57] ABSTRACT

A device for transmitting a drive force between a flexible element, such as cord, and a first rotatable, cylindrical body, said flexible element is trained around the casing surface of the body through a pre-determined angle, wherein a second cylindrical body is arranged with a rotating shaft parallel to that of the first, along which the flexible element is trained in opposing direction, said both bodies, preferably provided with at least one groove for receiving said flexible element, are embodied and/or placed such that the bodies rotate without slippage between flexible element and both cylindrical bodies.

32 Claims, 2 Drawing Sheets

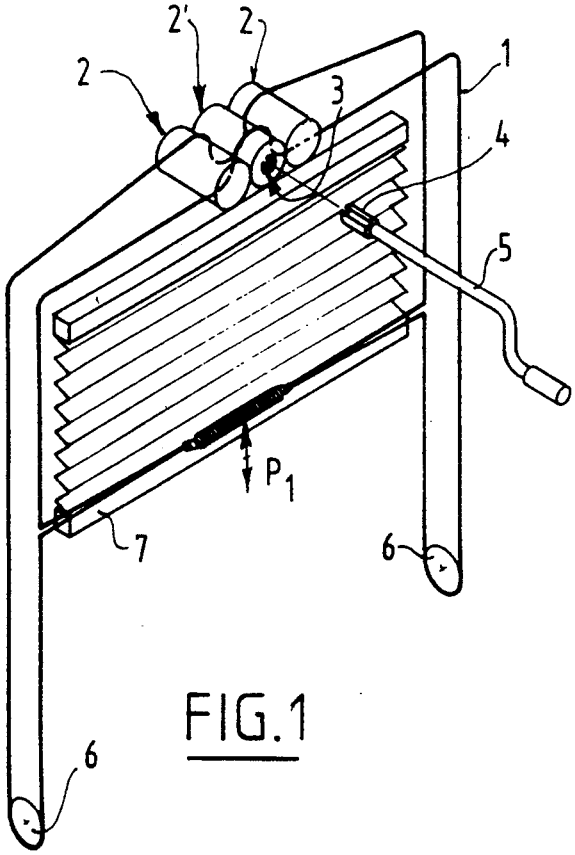
FIG.1
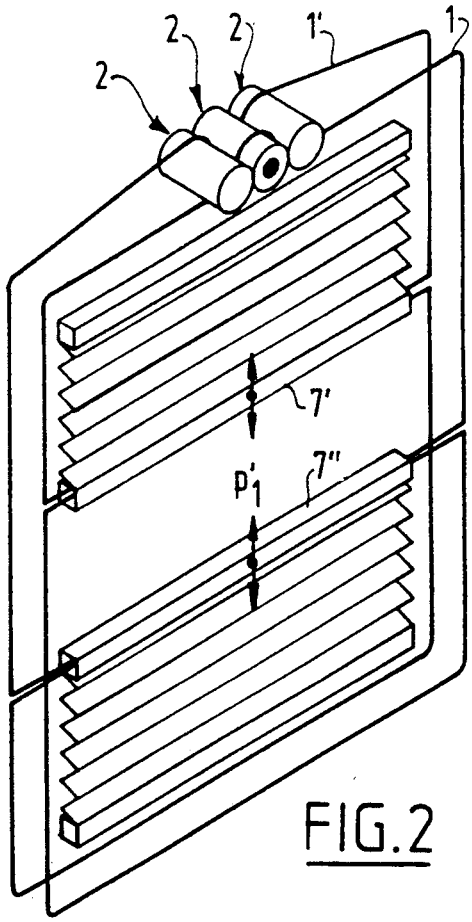
FIG.2
FIG.3
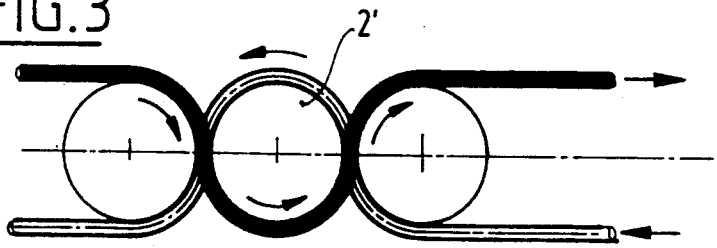
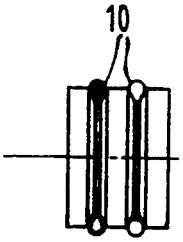
FIG.4
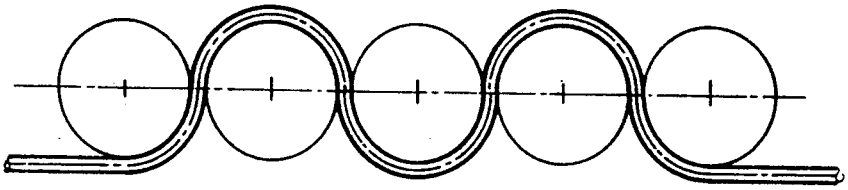
FIG.5

FIG.6
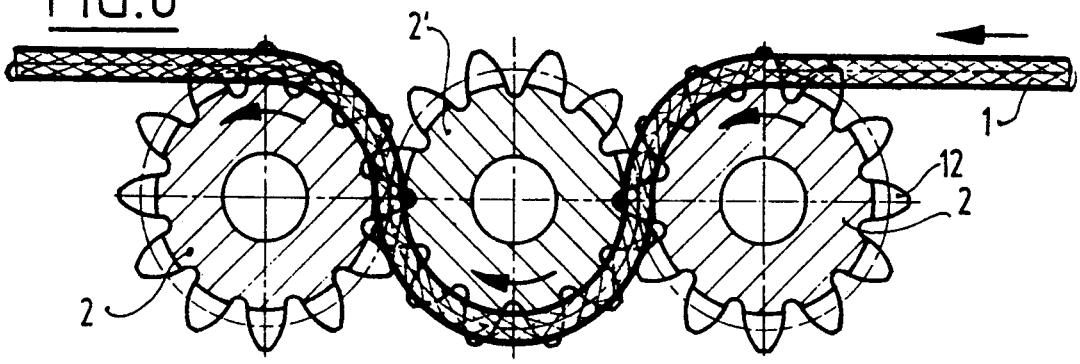
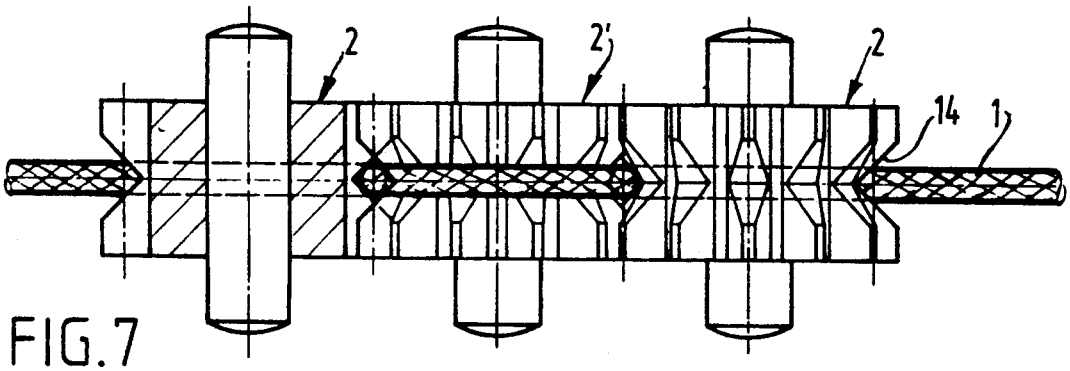
FIG.7
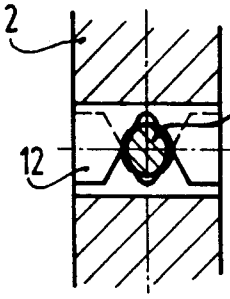
FIG.8
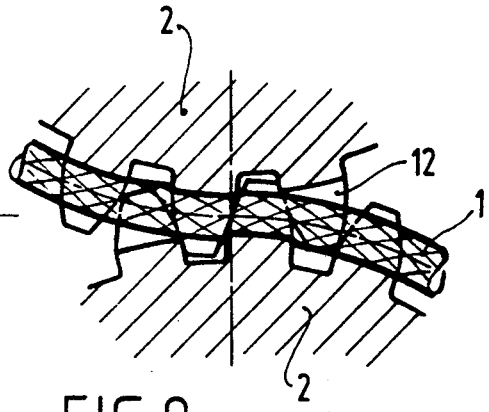
FIG.9

DEVICE FOR TRANSMITTING A DRIVE FORCE BETWEEN A FLEXIBLE ELEMENT AND A ROTATABLE BODY

BACKGROUND OF THE INVENTION

The invention relates to a device for transmitting a drive force between a flexible element, such as cord, and a rotatable, cylindrical body, wherein the flexible element is trained around the casing surface of the body through a pre-determined angle.

Such a device is known for example as a winch, wherein the rotatable body is the drum and the flexible element a rope or the like. The force transmission takes place through friction between both elements at the point of the turnover angle. Another embodiment has pulleys with the ropes associated therewith.

The invention has for its object to provide a device wherein a flexible element, preferably in the form of a cord, can be used in relatively small embodiments, particularly suitable for the driving of cords in sunblinds and the like. The device must occupy little space therein in view of the limited space and must have a wholly non-slip action since otherwise, in the case of double embodiments, there occurs a relative shifting between the flexible elements and the sunblinds will therefore go out of square.

SUMMARY OF THE INVENTION

The device according to the invention is distinguished in that a second cylindrical body is arranged with rotating shaft parallel to that of the first and along which the flexible element is trained in opposing direction, wherein both bodies are embodied and/or placed such that the bodies rotate without slippage between the flexible element and either cylindrical body.

The use of two cylindrical bodies is per se known, wherein the flexible element is usually trained through a greater angle than possible around the wheel that is driven or to be driven. Through the use of the mutual connection between both cylindrical bodies not only is the greater peripheral angle realized but also a double system for force transmission which takes place without slippage.

In a preferred embodiment each cylindrical body is provided with a gear wheel rim belonging to a transmission, which rims preferably engage each other directly. The required rotation direction of the cylindrical bodies is herewith brought into conformity with the path of the flexible element, wherein moreover notably little space is required.

In one embodiment, the distance between the casing surfaces of the two cylindrical bodies is smaller than the thickness of the flexible element, whereby the cylindrical bodies also serve as clamping members for increasing the permissible force to be transmitted without slippage occurring.

According to a further development of the invention at least one cylindrical body is provided with at least one groove for receiving the flexible element. In particular by making this groove V-shaped, a self-clamping action is obtained in the groove through the tension of the flexible element, whereby the force for transmission can also be increased without slippage occurring.

Finally, the invention proposes to recess the groove into the gear wheel rim of a cylindrical body whereby, in addition to the desired space-saving, a particularly good clamping and transmission action between flexible element and the group of cylindrical bodies can also take place.

Furthermore the groove in at least one of the gear wheel rims can be positioned with respect to the periphery of the confronting gear rim such that the passage space bounded between the mutually engaging teeth of the confronting gear wheel rims is smaller than the thickness of the cord, whereby an additional clamping action takes place at least at two points (depending on the depth and shape of the groove) on the periphery of the flexible element.

This clamping action ensures a shaggered deforming of the flexible element which gives an extra assurance against undesired slippage between the flexible element and the cylindrical bodies.

A groove can also be provided in each of the opposing gear wheel rims.

Each of the above measures can be applied separately or be used in any combination.

BRIEF DESCRIPTION OF THE DRAWINGS

Above mentioned and other features will be further elucidated in figure description below of a number of embodiments. In the drawing:

FIG. 1 shows a schematic perspective view of a transmission device according to the invention used with a single curtain and provided with three cylindrical bodies and two flexible elements, FIG. 2 shows a view corresponding with FIG. 1 of a device according to the invention employed with a double curtain, FIG. 3 shows a front view of a part of the device of FIG. 1 or 2 respectively on an enlarged scale, FIG. 4 is a side view of the device of FIG. 3, FIG. 5 shows a front view of an alternative embodiment of the device in FIG. 3, FIG. 6 shows an alternative embodiment of the device of FIG. 1 or 3 respectively, wherein the cylindrical bodies are provided with a gear wheel rim along which the flexible element is guided, FIG. 7 is a top view of the device of FIG. 6, FIG. 8 and 9 show respectively a transverse and lengthwise section of a portion of the device of FIG. 6 on an enlarged scale.

DESCRIPTION OF PREFERRED EMBODIMENTS

The device for transmitting a drive force between a flexible element and a cylindrical element is shown as used in a sunblind as according to FIG. 1 or 2. The flexible element 1 is used herein as a drive element for opening and closing a folding curtain. To this end the flexible element 1 is trained around three cylindrical bodies 2, the middle one 2' of which is provided with a central space 3 for receiving an end 4 of an operating handle 5 fitting therein. The flexible element 1 is trained around the rolls 2 in zigzag fashion such that in each case a cord 1 lies against the central cylindrical body 2' through at least 180°, see FIG. 3.

The guiding of the respective cords 1 and 1' in FIG. 1 is such and co-acting with reversing wheels 6 that, when the ends are fastened in the lower beam 7 of the folding curtain, they move up and down, when the wheels 2 turn, in the direction of the arrow $P_1$ depending on the rotation direction of the handle 5.

The cord guiding system is known and falls further outside the scope of the invention.

Likewise employed in FIG. 2 are two cords 1 and 1' which are used for moving up and down the lower beam 7' and upper beam 7'' respectively of the upper and lower curtain, wherein through the rotation of the wheels 2 the cords 1 and 1' are guided and moved such that these beams will begin to move up and down according to the arrows $P_1$ for simultaneous closing and opening of the window.

From the application it will be apparent that a non-slip transmission of forces between the wheels 2 and the cords 1 is necessary, since the beams 7, 7', 7'' otherwise move up and down unevenly.

In order to effect the non-slip transmission three cylindrical rolls 2 are arranged adjacent to each other, as already stated above. The distance between the casing surfaces of the rolls 2 is such that this is smaller than the thickness of the cord 1, thus resulting in a clamping action between the casing surfaces of adjacent rolls on the flexible element. In addition to the relatively large turnover angle around the middle roll 2' the cord 1 also obtains a clamping action at two points in order to prevent undesired slippage.

It can be advantageous to embody the casing surface of at least one of the rolls, for example roll 2', with V-shaped grooves 10, in each of which is received a cord 1 and 1' respectively. As a result of the tensile stress in the cords the V-shape of the groove causes a gripping action on the cord, which will likewise prevent slippage.

If necessary it can be required to arrange not three but five cylindrical bodies adjacent to each other, as shown in FIG. 5. The number of clamping points on the cord is herein increased to four while the turnover angle around the cylindrical bodies is three times 180°, wherein it can be assumed that the middle rolls are each driven at a speed such that the peripheral velocity of the casing surface is equal to that of the cord.

The driving of three cylindrical bodies can be simplified by providing these with a gear wheel rim 12, which is shown in FIG. 6. The gear wheel rims 12 of the cylindrical bodies 2 lying mutually adjacent engage each other and ensure a mutually non-slidable position of the cylindrical bodies.

The cord 1 can be trained around the cylindrical bodies 2 in accordance with the embodiment according to FIG. 3. The cord 1 can be trained around cylindrical casing surfaces in addition to the gear wheel rim, which surfaces may or may not be provided with grooves as according to FIG. 4.

It is also possible however to arrange the V-shaped groove 14 in the gear wheel rims 12 themselves, which is shown in FIG. 7, whereby the axial length of the cylindrical bodies can be limited considerably.

Furthermore, the V-shaped grooves can be dimensioned such that the passage space bounded by the mutually engaging teeth of the gear wheel rims 12 is smaller than the thickness of the cord 1, see FIG. 8, whereby an extra clamping action takes place at four points on the periphery of the flexible element 1. This clamping action ensures a staggered deforming of the flexible element 1, as in FIG. 9, which gives an extra assurance against undesired slippage between the flexible element 1 and the cylindrical bodies 2.

The invention is not limited to the embodiments described above. Diverse variations and combinations of the above described features are therefore possible.

The device according to the invention is moreover described as a device for transmitting a force from a cylindrical body to a cord. The reverse hereof, a driven cord 1 transmitting forces to a group of cylindrical bodies consisting of at least two elements, is of course also possible.

I claim:

1. Device for transmitting a drive force between a flexible element and a first rotatable cylindrical body, wherein the flexible element is trained through a predetermined angle about the first cylindrical body in one direction, characterized in that a second cylindrical body is arranged in parallel to the first cylindrical body and around which the flexible element is trained in an opposite direction, wherein both cylindrical bodies are placed such that the bodies rotate without slippage relative to the flexible element and the cylindrical bodies clamp the flexible element therebetween.

2. Device as claimed in claim 1, characterized in that each cylindrical body is provided with a gear wheel rim acting as transmission between the cylindrical bodies.

3. Device as claimed in claim 1, characterized in that a space between the cylindrical bodies is smaller than a thickness of the flexible element.

4. Device as claimed in claim 1, characterized in that at least one of the cylindrical bodies is provided with a groove for receiving the flexible element.

5. Device as claimed in claim 4, characterized in that the one cylindrical body has a gear wheel rim and the groove is recessed into the gear wheel rim.

6. Device as claimed in claim 5, characterized in that the groove is V-shaped.

7. Device as claimed in claim 4, characterized in that each cylindrical body is formed with a groove in a gear wheel rim and a passage of the two grooves in the gear wheel rims is smaller than the thickness of the flexible element.

8. Device as claimed in claim 1, characterized in that at least one of the cylindrical bodies is provided with a central recess for receiving a control member such as a hand crank.

9. A device as claimed in claim 8 wherein the flexible element is a cord of a sunblind.

10. A liftable blind assembly for selectively opening and closing a generally rectangular opening having left and right sides, said assembly comprising a movable beam, having left and right ends, at least one flexible drive element arranged in a continuous loop and engaging said movable beam, a drive roll arrangement including at least first, second and third drive rolls, said rolls rotating in alternately opposite rotational senses, first guides at left and right top corners of the opening, second guides disposed adjacent left and right bottom corners of the opening, the continuous loop including a first run, which operatively engages the right end of the movable beam, passes under the second guide at the right bottom corner of the opening, over the first guide at the right top corner of the opening under the first roll, over the second roll, under the third roll over the first guide at the left top corner of the opening and operatively engages the left end of the movable beam and wherein the continuous loop includes a second run which operatively engages the left end of the movable beam, passes under the second guide at the left bottom corner of the opening, over the first guide at the left top corner of the opening, over the third roll, under the second roll, over the first roll, over the first guide at the right top corner of the opening and operatively engages the right end of the movable beam, wherein said drive element is in frictional contact with peripheral surface portions of said drive rolls over subtending angles totalling at least 360 degrees.

11. An assembly as claimed in claim 10, wherein said drive rolls each include two circumferential grooves, one groove of each roll accommodating the first run and the other groove the second run of the continuous loop.

12. An assembly as claimed in claim 10, wherein said movable beam is hollow and further comprises a tension spring located in the hollow interior, and wherein the flexible drive element is attached at each end of said tension spring and operatively engages the left and right ends of the movable beam.

13. An assembly as claimed in claim 10, wherein said drive rolls further comprise peripheral gear teeth which operatively engage one another to cause said rolls to positively be driven in alternatively opposite rotational senses.

14. An assembly as claimed in claim 13, wherein one of said rolls includes a central groove adjoined on two sides by said peripheral gear teeth in which groove said flexible drive elements engage.

15. An assembly as claimed in claim 14, wherein a groove is provided in each said rolls, said grooves have a truncated V-shape, defining an inner surface and wherein said flexible drive element engages the inner surface at both sides of the V-groove.

16. A liftable blind assembly for selectively closing a generally rectangular opening having left and right sides, said assembly comprising a movable beam, having left and right ends, at least one flexible drive element arranged in a continuous loop and engaging said movable beam, a drive roll arrangement including at least first, second and third drive rolls, peripheral gear teeth on said rolls which operatively engage one another to cause said rolls to positively be driven in alternately opposite rotational senses, first guides at left and right top corner of the opening, second guides disposed adjacent left and right bottom corner of the opening, the continuous loop including a first run, which operatively engages the right end of the movable beam, passes under the second guide at the right bottom corner of the opening, over the first guide at the right top corner of the opening, under or over the first roll, over or under the second roll and then under or over the third roll, to be engaged by the teeth on said rolls, over the first guides at the left top corner of the opening and operatively engages the left end of the movable beam and wherein the continuous loop includes a second run which operatively engages the left end of the movable beams, passes under the second guide at the bottom left corner of the opening, over the first guide at the left top corner of the opening, over the first guide at the right top corner of the opening and operatively engages the right end of the movable beam.

17. An assembly as claimed in claim 16, wherein one of said rolls includes a central groove adjoined on two aides by said peripheral gear teeth in which groove said flexible drive element engage.

18. An assembly as claimed in claim 17, wherein a groove is provided in each of said rolls, said grooves have a truncated V-shape, defining an inner surface and wherein said flexible drive element engages the inner surface at both sides of the V-groove.

19. An assembly as claimed in claim 16, and further comprising a second movable beam having left and right ends, the right end being operatively connected to the first run of the flexible element between the second guide adjacent the bottom corner of the opening and the first guide at the right top corner of the opening and the left end of the second movable beam being operatively connected to the second run between its first guide at the left top corner of the opening and the second guide adjacent the bottom left corner of the opening.

20. Blind assembly for selectively opening and closing an opening comprising a rotatable drive body for transmitting a drive force to a movable beam, wherein a flexible drive element is arranged in a continuous loop engaging the movable beam so as to open and close said opening upon rotation of said rotatable drive body, characterized in that said continuous loop includes a first run and a second run each engaging opposite ends of said movable beam and wherein said first and second runs are each resiliently closed, wherein the rotatable drive body is in the form of a first cylindrical roll, around which the flexible drive element is trained through a predetermined angle around a peripheral surface of the first cylindrical roll, further comprising a second rotatable roll arranged with its axis of rotation parallel to that of the first roll and around which second roll the flexible element is trained in an opposing curve and wherein both first and second rolls are positioned such that they clamp the flexible drive-element therebetween and rotate without slippage between the flexible element and both rolls.

21. Assembly according to claim 20, wherein said continuous loop is arranged around the periphery of the opening.

22. Assembly according to claim 21, wherein said second run of said continuous loop is driven in a direction opposite to that of the first run.

23. Assembly according to claim 21, wherein said opening is generally rectangular having left and right sides and wherein the portions of the continuous loop extending from the rotatable drive body (7; 7'; 7'') toward the movable beam (7; 7'; 7'') along each left and right side of the opening each comprise a corresponding portion of said first and second runs.

24. Assembly according to claim 20, wherein said continuous loop incorporates at least one tension spring.

25. Assembly according to claim 24, wherein said first and second runs each incorporate a separate tension spring.

26. Assembly according to claim 20, further comprising a second movable beam having left and right ends, the right ends being operatively engaged by the first run of the flexible element and the left end being operatively engaged by the second run of the flexible element.

27. Assembly according to claim 20, further comprising a third roll, the first, second and third rolls rotating in alternatively opposite rotational senses, whereby the flexible drive element is in frictional contact with peripheral surface portions of the drive bodies over subtending angles totalling at least 360 degrees.

28. Assembly according to claim 20, wherein at least one of said first and second rolls includes two circumferential grooves, one groove accommodating the first run and the other groove accommodating the second run of the continuous loop.

29. Assembly according to claim 28, wherein each groove has a V-shape defining an inner surface which engages the flexible drive element at both sides.

30. Assembly according to claim 20, wherein said rotatable drive body is drivingly engageable by a rotatable operating member.

31. Blind assembly for selectively opening and closing an opening comprising a rotatable drive body for transmitting a drive force to a movable beam, wherein a flexible drive element is arranged in a continuous loop engaging the movable beam, so as to open and close said opening upon rotation of said rotatable drive body, characterized in that said continuous loop includes a first run and a second run each engaging opposite ends of said movable beam and wherein said first and second runs are each resiliently closed, wherein the rotatable drive body is in the form of a first cylindrical roll, around which the flexible drive element is trained through a predetermined angle around a peripheral surface of the first cylindrical roll, further comprising a second rotatable roll arranged with its axis of rotation parallel to that of the first roll and around which second roll the flexible element is trained in an opposing curve and wherein both first and second rolls are positioned such that they rotate without slippage between the flexible element and both rolls, wherein said first and second rolls comprise peripheral gear teeth which operatively engage one another to cause said adjacent drive rolls to be positively driven in opposite rotational senses.

32. Assembly according to claim 31, wherein each groove is recessed into the gear teeth.

* * * * *